United States Patent [19]

Ichikawa et al.

[11] Patent Number: 4,985,923

[45] Date of Patent: Jan. 15, 1991

[54] HIGH EFFICIENCY VOICE CODING SYSTEM

[75] Inventors: Akira Ichikawa, Musashino; Yoshiaki Asakawa, Kawasaki; Akio Komatsu, Kodaira; Eiji Oohira, Hachioji, all of Japan

[73] Assignee: Hitachi, Ltd., Tokyo, Japan

[21] Appl. No.: 328,702

[22] Filed: Mar. 27, 1989

Related U.S. Application Data

[63] Continuation of Ser. No. 895,916, Aug. 13, 1986, abandoned.

[30] Foreign Application Priority Data

Sep. 13, 1985 [JP] Japan ..... 60-201542

[51] Int. Cl.[5] ..... G10L 7/02

[52] U.S. Cl. ..... 381/38

[58] Field of Search ..... 381/29-32, 381/36-41, 43-45; 364/513.5

[56] References Cited

U.S. PATENT DOCUMENTS 4,712,243 12/1987 Ninomiya et al. ..... 381/43

OTHER PUBLICATIONS

Gersho et al., "Vector Quantization: A Pattern-Matching Technique for Speech Coding", IEEE Comm. Mag., 12/83, pp. 15-21.

Oyama, "A Stochastic Model . . . Speech Analysis-Synthesis.", IEEE ICASSP-85, 25.2.1-25.2.4.

Roucos et al., "Segment Quantization for Very-Low-Rate Speech Coding", IEEE ICASSP 82, pp. 1565-1568.

Ichikawa et al., "A Speech Coding Method Using Thinned-Out Residual, "IEEE ICASSP-85, pp. 25.7.1-25.7.4.

Atal et al., "A New Model of LPC Excitation for Producing Natural-Sounding Speech at Low Bit Rates," IEEE ICASSP 82, pp. 614-617.

Rebolledo et al., "A Multirate Voice Digitizer Based Upon Vector Quantization", IEEE Trans. on Communications, vol. COM-30, No. 4, 4/82, pp. 721-727.

Gray, "Vector Quantization", IEEE ASSP Magazine, vol. 1, No. 2, 4/84, pp. 4-29.

Abut et al., "Vector Quantization of Speech and Speech-Like Waveforms", IEEE Trans. ASSP, vol. ASSP-30, No. 3, 6/82, pp. 423-435.

Wong, "An 800 Bit/s Vector Quantization LPC Vocoder", IEEE Trans. ASSP, vol. ASSP-30, No. 5, 10/82, pp. 770-780.

Cooperi et al., "Jector Quantization and Perceptual Criteria for Low-Rate Coding of Speech", ICASSP 85, 3/85, pp. 7.6.1-7.6.4.

*Primary Examiner*—Dale M. Shaw
*Assistant Examiner*—John A. Merecki
*Attorney, Agent, or Firm*—Antonelli, Terry, Stout & Kraus

[57] ABSTRACT

A voice coding system for separating and coding voice information into spectrum envelope information and voice source information, with the intention of compressing the amount of information for efficient coding of vocal audio signals through the control of the voice source information based on the fact that the spectrum envelope information and voice source information highly correlate with each other.

6 Claims, 3 Drawing Sheets

HIGH EFFICIENCY VOICE CODING SYSTEM

This application is a Continuation of application Ser. No. 895,916, filed Aug. 13, 1986, now abandoned.

BACKGROUND OF THE INVENTION

This invention relates to a high-efficiency voice coding system and, particularly, to a high-quality speech transmission system operative with a smaller amount of information.

There have been widely known and practiced the PARCOR system and LSP system for efficiently coding the voice sound into information at less than 10 kbps. These systems, however, are not qualified enough to transmit a faint voice sound which barely allows the listener to identify the speaker. More sophisticated systems intended to enhance the above-mentioned ability include the Multi-pulse method offered by B. Atal, Bell Telephone Laboratories Inc. (B.S. Atal et al. "A New Model of LPC Excitation for producing Natural-Sounding Speech at Low Bit Rates", Proc. ICASSP 82 S5. 10, 1982), and the Thinned Residual method offered by the inventors of the present invention (A. Ichikawa et al., "A Speech Coding Method Using Thinned-out Residual", Proc. ICASSP 85, 25.7, 1985). However, at least a certain amount of information (around 8 kbps) is required to assure the sound quality reproduced, and it is difficult to compress information down to 2.0–2.4 kbps used by international data lines and the like.

Another method for drastically compressing voice information is the Vector Quantization method (e.g., S. Roucos et al., "Segment Quantization for Very-Low-Rate Speech Coding", Proc. ICASSP 82, p. 1563). This method, however, mainly deals with the information rate below 1 kbps and lacks in the clearness of reproduced voice sound. Although the combination of the Vector Quantization method with the above-mentioned Multi-pulse method is now under study, it is necessary for source information determining the fine structure of vectors to have considerable content, and therefore transmission of vocal audio signals qualified at above 10 kbps using an information content around 2 kbps is not feasible in the present state of art.

The voice sound is created by the mouth which is a physically restricted organ of the human body, and, when viewed from the physical characteristics of the voice sound, the parameters representing the physical characteristics of the voice sound take values eccentrically. Namely, the mouth is limited in the variation of shape, and therefore the range of vocal characteristics (e.g., sound spectrum) is also limited.

In the Vector Quantization method, the parametric space which the voice sound exists is partitioned into segments of a certain area, the segments are coded, and the vocal audio signal is transmitted in the form of codes. Methods such as the LPC method, in which the vocal signal is broken down into spectrum envelope information and fine structural information. Both types of information are transmitted in the form of codes and both types of codes are combined to reproduce the original voice sound in the receiver system. Both are reputed for their possibility of efficient compression for voice information and are applied to extensive purposes. Particularly, spectrum envelope information is confined in a certain range of attribute, allowing relatively simple approximation by combining of a few resonant and antiresonant characteristics, and is suitable for vector quantization.

There have been proposed several voice transmission methods in which fine structural information is regarded as the noise because of its resemblance in characteristics to the white noise, as described for example in G. Oyama et al., "A Stochstic Model of Excitation Source for Linear Prediction Speech Analysis-Synthesis", Proc. ICASSP 85, 25-2, 1985. However, this proposal is expected to deal with an amount of information of around 11.2 kbps only for the fine structure, and compression of information is not easy as mentioned previously.

SUMMARY OF THE INVENTION

An object of this invention is to overcome the foregoing prior art problems and provide a high-quantity, efficient voice coding system.

With the intention of achieving the above objective, this invention resides in the compression of information based on the fact that spectrum envelope information and fine structural information are highly correlative with each other.

It is well known that spectrum envelope information correlates with the pitch frequency. For example, the man's body is generally larger than the woman's body, and the former has a larger voice-making organ, mouth, than that of the latter. On this account, the formant frequency (resonance frequency of the mouth), which is spectrum envelope information, is lower for men than for women. The pitch frequency, which determines the tone of voice, is also lower on the part of men, as it is commonly known. These facts have also been confirmed experimentally (e.g., refer to article "Auditory Perception and Speech, New Edition", p. 355, edited by Miura, the Institute of Electronics and Communication Engineers of Japan, 1980.)

It is also known that the pitch frequency and the source amplitude are highly correlative with each other (e.g., refer to article "Pitch Quanta Generation by Amplitude Information", by Suzuki et al., p. 647, Proc. Acoustic Society of Japan, May 1980.).

The present invention is intended to provide a novel method for information compression by utilization of the above-mentioned correlative characteristics of the voice sound. The voice sound to be transmitted is transformed into a string of codes by vector quantization using spectrum envelope information, and subsequently fine structural information is selected only in vectors of spectrum fine structural information that highly correlate with the codes. This allows specification of fine structural vectors only in the range designated by spectrum envelope vectors, resulting in a considerable reduction of information as compared with the amount of information necessary for specifying specific vectors in the whole range in which vectors can exist as spectrum fine structural vectors. Moreover, it becomes possible to compress fine structural information in the manner of hierarchical coding by utilization of correlations between the pitch frequency and each of the source amplitude and residual source waveform.

FIG. 1 shows the high correlation between the spectrum and pitch period. Among vocal pitch periods represented by vectors which indicate spectrum information, a pitch frequency with a highest frequency of occurrence is selected. Next, a voice sound (input vocal audio signal) is analyzed to obtain the spectrum and pitch period, and spectrum information is replaced with a vector to obtain a pitch period corresponding to the vector. The pitch period evaluated in the input voice sound is compared with the pitch period determined from the vector, with the result shown in FIG. 1. Both pitch periods highly coincide with each other, manifesting a high correlation between the spectrum and pitch period.

In such a special case as of the above example, where the spectrum and pitch period are in extremely close correspondence, the pitch and the source amplitude are determined automatically once the vector of spectrum has been determined, which implies that information related to the pitch and the source amplitude need not be transmitted. In general cases, however, a certain range of selection should preferably be allowed if it is intended to deal with a critical voice information.

Suppose an example of using the linear prediction coefficient (LPC) as spectrum envelope information and the prediction residual waveform as spectrum fine structural information. The number of vectors of spectrum envelope information is not more than 400 in the case of a voice recognition system oriented to unspecified speakers (e.g., refer to Asakawa et al., "Study on Unspecified Speakers' Continuous Numeric Speech Recognition Method", Acoustic Society of Japan, Voice Study Group Tech. Report, S83-53, Dec. 1983). Since the vocal signal transmission deals with small person-to-person differences, the number of vector types is set as many as 4096 (12 bit), and in combination with the prediction residual waveform the voice sound can be reproduced in appreciably high accuracy.

In the usual LPC composition, it is known that 5-bit pitch frequency information is sufficient when treated independently of spectrum information. In this invention, use of correlation enables further compression down to 3 bits. By the same reason, amplitude information can be as small as 2 bits. The residual waveform, when extracted in the form of pitch period, may take 3 bits, and the use of correlation between the spectral vector (12 bits) and pitch period (3 bits) provides the resolution capable of specifying virtually $12+3+3=18$ (bits) types. This is equivalent to the selection among 262,144 kinds of waveforms, and it is supposed to be a sufficient amount of information.

Setting the interval of voice analysis and transmission to 10 ms or 20 ms (this interval is called "frame", and further reduction of this value has little effect on the sound quality as is known from the experience), the amount of information inclusive of the spectrum envelope and spectrum fine structure is 2 kbps (for the 10 ms frame) or 1 kbps (for the 20 ms frame).

DESCRIPTION OF THE PREFERRED EMBODIMENT

An embodiment of this invention will now be described with reference to FIGS. 2 and 3. This embodiment uses the linear prediction coefficient as spectrum envelope information and the prediction residual waveform as spectrum fine structural information, although the essence of this invention is not confined to this combination. An embodiment of the encoder unit and decoder unit used in this invention will be described with reference to FIGS. 2 and 3, respectively.

Figure 1:
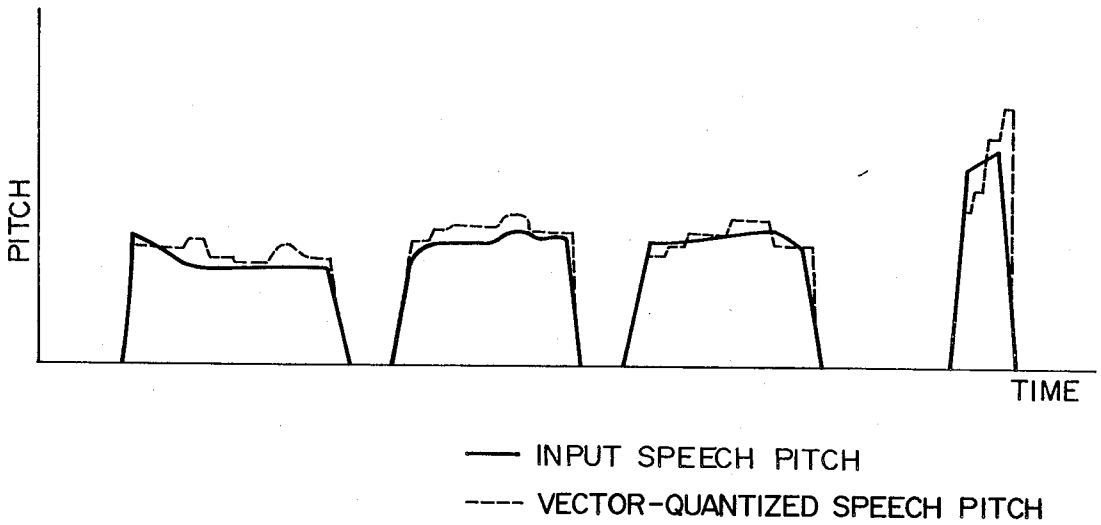
FIG. 1 is a graph used to explain the principle of the invention.
Figure 2:
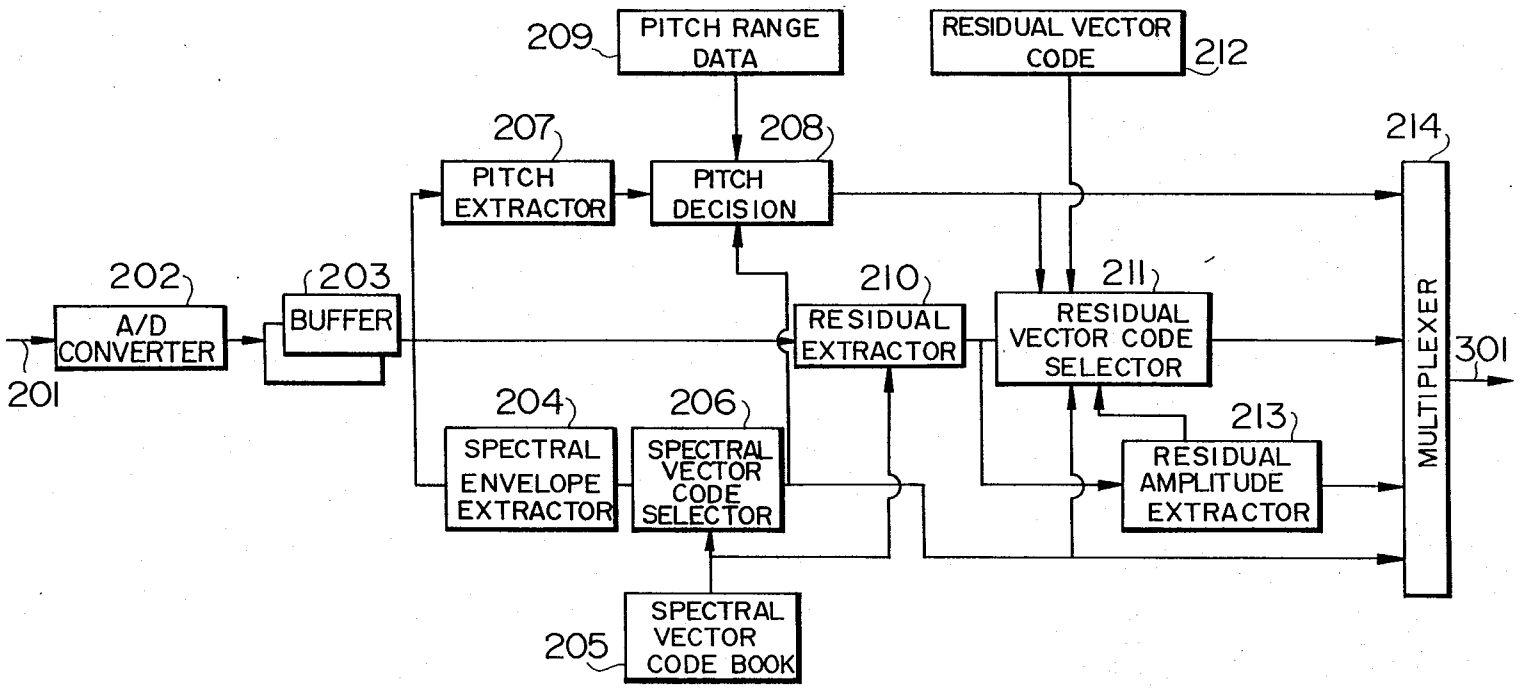
FIG. 2 is a block diagram used to explain the encoder unit of this invention.
Figure 3:
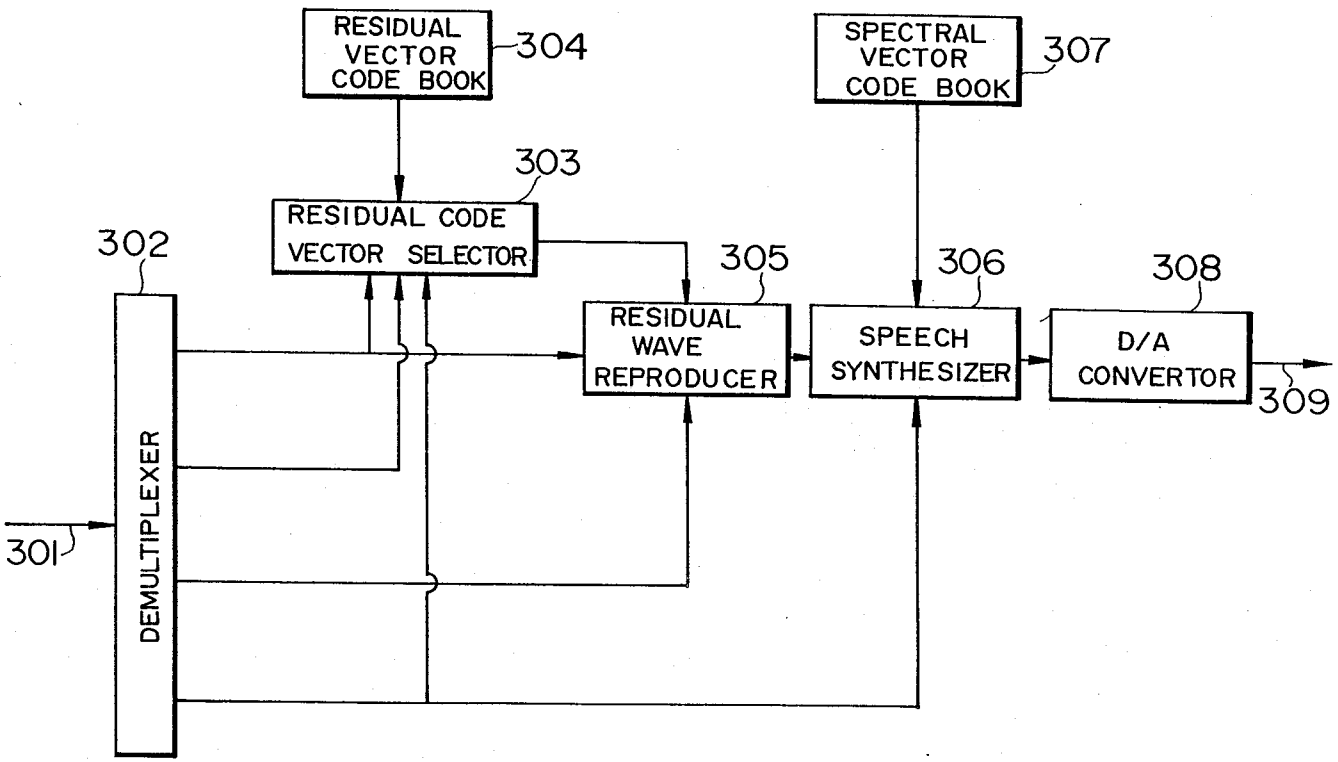
FIG. 3 is a block diagram used to explain the decoder unit of this invention.

In FIG. 2, an input speech signal 201 is transformed into a digital signal by an A/D converter 202, and it is fed to an input buffer 203. The buffer 203 has two data holding sections so that during the encoding process for speech data with a certain length the next speech data can be held uninterruptedly. The speech data held in the buffer 203 is read out in segments of a certain length and delivered to a spectral envelope extractor 204, pitch extractor 207 and residual wave extractor 210. The spectral envelope extractor 204 has its output supplied to a spectral vector code selector 206. The spectral envelope extractor 204 implements linear prediction analysis using means which are well known in the art. The spectral vector code selector 206 collates a prediction coefficient obtained as a result of analysis with spectrum information in a spectral vector code book 205 sequentially, and selects to output a spectrum code with the highest resemblance. This procedure can be carried out by the hardware arrangement similar to the usual voice recognition system. The selected spectral vector code is sent to a pitch decision unit 208 and code assembling multiplexer 214, while corresponding spectrum information is sent to a residual vector code selector 211.

The pitch extractor 207 can readily be configured using the well known AMDF method or autocorrelation method. The pitch decision unit 208 reads out the range of pitch specified by the spectral vector code from a pitch range specification data memory 209, determines a pitch frequency selectively among candidates provided by the pitch extractor 207, and sends it to the code assembling multiplexer 214 and residual vector code selector 211.

The following describes the operation of the pitch decision unit 208. As mentioned previously, pitch ranges appearing in correspondence to one spectral vector code are confined to certain specific values. The maximum and minimum values of period defining possible ranges for respective spectral vector codes are stored as a table in a pitch range data memory 209. The maximum and minimum pitch periods are read out of the pitch range data memory 209 in accordance with the vector code provided by the spectral vector code selector 206, and a fitting pitch period is determined selectively from among the candidates provided by the pitch extractor 207.

The residual wave extractor 210 consists of usual linear prediction type inverse filters, operating to fetch from the spectral vector code book 205 spectrum information corresponding to the code selected by the spectral vector code selector 206 into the inverse filters, introduce the input speech waveform from the buffer 203, and extract residual waveforms. The extracted residual waveforms are delivered to the residual wave vector code selector 211 and residual amplitude extractor 213. The residual amplitude extractor 213 calculates the mean amplitudes of the residual waveforms and sends it to the residual wave vector code selector 211 and code assembling multiplexer 214.

The residual wave vector code selector 211 fetches from the residual wave vector code book 212 candidate residual wave vectors based on the spectral vector code provided by the spectral vector code selector 206 and the pitch frequency provided by the pitch decision unit 208, and collates them with the residual waveform sent from the residual wave extractor 210 to determine a residual wave vector with the highest resemblance.

One or more kinds of residual waveforms are stored together with the code number against key parameters of the residual wave vector code and pitch frequency code. These residual waveforms are read out as candidates, compared with the output of the residual wave extractor 210 by the residual vector code selector 211, and the most fitting vector code is outputted selectively as residual code. For the comparison process, the amplitude is normalized using residual amplitude information. The selected residual wave vector code is sent to the code assembling multiplexer 214. The code assembling multiplexer 214 receives and assembles the spectral vector code, residual wave vector code, pitch frequency code and residual amplitude code, and sends out a code signal over a transmission path 301.

Next, an embodiment of the decoder unit will be described with reference to FIG. 3. In FIG. 3, a code sent over the transmission path 301 is received by a code demultiplexer 302 and separated into a spectral vector code, residual wave vector code, pitch period code and residual amplitude code. The spectral vector code is delivered to a residual wave selector 303 and speech waveform synthesizer 306, the residual wave vector code is fed to the residual wave selector 303, the pitch period code is fed to the residual wave selector 303 and residual source wave reproducer 305, and the residual amplitude code is fed to the residual source wave reproducer 305.

The residual wave selector 303 selects a residual waveform used for the spectral vector code, residual wave vector code and pitch period from among the contents of the residual wave vector code book 304, and supplies it to the residual wave reproducer 305. The residual wave vector code book 304 is arranged so that one residual waveform is outputted by being keyed by each combination of the spectrum code, pitch period code and residual wave vector code.

The residual wave reproducer 305 turns the selected residual waveforms into waveforms using the pitch period codes repeatedly, modifies the amplitude using the residual amplitude codes, and supplies a series of reproduced residual waveforms to the speech waveform synthesizer 306. The speech waveform synthesizer 306 reads out spectrum parameters used for the spectral vector code from the spectral vector code book 307, sets them in the internal synthesizing filters, and implements speech waveform synthesis for the reproduced residual waveforms.

The spectral vector code book 307 is arranged to provide synthesizing filter parameters in response to the entry of spectral vector codes. The speech waveform synthesizing filters may be of the LPC type commonly used for RELP. The synthesized speed waveform is transformed back to an analog signal by a D/A converter 308, and it is sent out as a reproduced vocal signal 309. Signals other than vocal signals, such as tone signals, can also be transmitted by being recorded in the spectral vector code book 307.

According to this invention, as described above, the voice sound can be coded in an extremely high quality condition using a small amount of information.

We claim:

1. A speech coding system for transmitting speech using a small amount of information comprising:

means for inputting speech and transforming said speech into a digitized speech signal;

vector quantization means for extracting spectrum envelope information from said digitized speech signal, matching said extracted spectrum envelope information with spectrum envelope information prestored in a spectrum vector code memory, said spectrum envelope information prestored in said spectrum vector code memory corresponds to respective spectrum vector codes and outputting a spectrum vector code corresponding to spectrum envelope information in said spectrum vector code memory which has the highest resemblance to said extracted spectrum envelope information based on said matching;

means for extracting speech source information from said digitized speech signal;

speech source information coding means for selecting candidate speech source information from speech source information prestored in a memory, said selected speech source information corresponding to said spectrum vector code output by said vector quantization means, matching said extracted speech source information with said selected speech source information and outputting a speech source vector code corresponding to speech source; information of said selected speech source information having the highest resemblance to said extracted speech source information; and means for transmitting said spectrum vector code provided by said vector quantization means and said speech source vector code provided by said speech source information coding means.

2. A speech coding system according to claim 1, wherein said vector quantization means comprises a spectrum envelope extractor for extracting a spectrum envelope from said digitized speech signal, a spectrum vector code memory for prestoring spectrum envelope information, and a spectrum vector code selector for sequentially collating spectrum information provided by said spectrum envelope extractor with spectrum information from said spectral vector code memory and outputting a spectrum vector code corresponding to spectrum envelope information with a highest resemblance to said extracted spectrum envelope.

3. A speech coding system according to claim 1, wherein said speech source information coding means comprises a pitch extractor for extracting a pitch signal from said digitized speech signal, a pitch range specifying data memory for storing ranges of pitch data, and a pitch range decision unit which selects a pitch period, within a range specified by said pitch range specifying data memory, from an output of said pitch extractor based on said spectrum vector code output of said vector quantization means.

4. A speech coding system for transmitting speech using a small amount of information comprising:

means for inputting speech and transforming said speech into a digitized speech signal;

vector quantization means for extracting spectrum envelope information from said digitized speech signal, matching said extracted spectrum envelope information with spectrum envelope information prestored in a spectrum vector code memory said spectrum envelope information prestored in said spectrum vector code memory corresponds to respective spectrum vector codes and outputting a spectrum vector code corresponding to spectrum envelope information in said spectrum vector code memory which has the highest resemblance to said extracted spectrum envelope information based on said matching;

means for extracting speech source information from said digitized speech signal;

speech source information coding means for selecting candidate speech source information from speech source information prestored in a memory, said selected speech source information corresponding to said spectrum vector code output by said vector quantization means, matching said extracted speech source information with said selected speech source information and outputting a speech source vector code corresponding to speech source information of said selected speech source information having the highest resemblance to said extracted speech source information; and means for transmitting said spectrum vector code provided by said vector quantization means and said speech source vector code provided by said speech source information coding means;

wherein said speech source information coding means comprises a pitch extractor for extracting a pitch signal from said digitized speech signal, a pitch means specifying data memory for storing ranges of pitch data, and a pitch range decision unit which selects a pitch period, within a range specified by said pitch range specifying data memory, from an output of said pitch extractor based on said spectrum vector code output of said vector quantization means; and wherein said speech source information coding means comprises a residual waveform extractor for extracting a residual waveform from said digitized speech signal, a residual waveform code memory for storing residual waveform vectors, and a residual waveform vector code selector which collates a residual waveform extracted by said residual waveform extractor with residual waveforms within a certain range stored in said residual waveform code memory based on said spectrum vector code output of said vector quantization means and a pitch period determined by said pitch range decision unit and wherein said residual waveform vector code selector selects a residual waveform with a highest resemblance to said extracted residual waveform.

5. A speech coding system for separating an original speech signal into a spectrum envelope signal and a speech source signal and to reproduce the original speech signal from the separated signals, said system comprising:

vector quantization means for extracting spectrum envelope information from a speech signal, matching said extracted spectrum envelope information with spectrum envelope information prestored in a spectrum vector code memory, said spectrum envelope information prestored in said spectrum vector code memory corresponds to respective spectrum vector codes and outputting a spectrum vector code corresponding to spectrum envelope information in said spectrum vector code memory which has the highest resemblance to said extracted spectrum envelope information based on said matching;

means for extracting speech source information from said speech signal; and speech source information coding means for selecting candidate speech source information from speech source information prestored in a memory, said selected speech source information corresponding to said spectrum vector code output by said vector quantization means, matching said extracted speech source information with said selected speech source information and outputting a speech source vector code corresponding to speech source information of said selected speech source information having the highest resemblance to said extracted speech source information.

6. A speech coding system according to claim 5, wherein said speech source information coding means comprises:

a pitch extractor for extracting a pitch signal from said speech signal;

a pitch range specifying data memory for storing ranges of pitch data;

a pitch range decision unit which selects a pitch period, within a range specified by said pitch range specifying data memory, from an output of said pitch extractor based on said spectrum vector code output of said vector quantization means;

a residual waveform extractor for extracting a residual waveform from said speech signal;

a residual waveform code memory for storing residual waveform vectors; and a residual waveform vector code selector which collates a residual waveform extracted by said residual waveform extractor with residual waveforms within a certain range stored in said residual waveform code memory based on said spectrum vector code output of said vector quantization means and a pitch period determined by said pitch range decision unit; and wherein said residual waveform vector code selector select a residual waveform with a highest resemblance to said extracted residual waveform.

* * * * *